United States Patent [19]

Whitacre

[11] Patent Number: 5,000,332

[45] Date of Patent: Mar. 19, 1991

[54] WASTE DISPOSAL CONTAINER WITH A NON-REMOVABLE, PERMANENT CLOSURE

[76] Inventor: Robert J. Whitacre, 13231 - 42nd Ave. NE., Seattle, Wash. 98125

[21] Appl. No.: 361,358

[22] Filed: Jun. 5, 1989

[51] Int. Cl.[5] ..... B65D 41/04

[52] U.S. Cl. ..... 215/330; 215/232

[58] Field of Search ..... 215/221, 225, 232, 330; 220/15, 315, 359

[56] References Cited

U.S. PATENT DOCUMENTS

| | | | |
|---|---|---|---|
| 1,873,830 | 8/1932 | Duponti . | |
| 2,423,582 | 7/1947 | Coleman | 215/330 X |
| 3,871,545 | 3/1975 | Bereziat | 215/330 X |
| 3,905,509 | 9/1975 | Markowitz | 215/330 X |
| 3,924,769 | 12/1975 | Fillmore | 215/330 X |
| 3,977,557 | 8/1976 | Hazard | 215/330 X |
| 4,209,100 | 6/1980 | Uhlig | 215/216 |
| 4,281,778 | 8/1981 | Stull | 215/330 X |
| 4,310,101 | 1/1982 | Sekine | 215/330 |
| 4,736,859 | 4/1988 | Mayes et al. | 215/330 |
| 4,747,498 | 5/1988 | Gach | 215/232 |

FOREIGN PATENT DOCUMENTS

| | | | |
|---|---|---|---|
| 1268262 | 6/1961 | France | 215/330 |
| 0847332 | 9/1960 | United Kingdom | 215/330 |

*Primary Examiner*—Stephen Marcus
*Assistant Examiner*—Nova Stucker
*Attorney, Agent, or Firm*—David L. Garrison

[57] ABSTRACT

A waste disposal container having a non-removable, permanently sealing, threaded closure. The closure consists of a outer cap and a inner, threaded base cap having one-way, interengaging ratchet teeth which affixes the closure to the neck of a waste disposal container. When the base cap is threaded on the threaded container neck, suitable adhesive is applied to the interior threads of the base cap and to the exterior threads on the container neck thereby permanently sealing the container.

16 Claims, 3 Drawing Sheets

FIG. 1
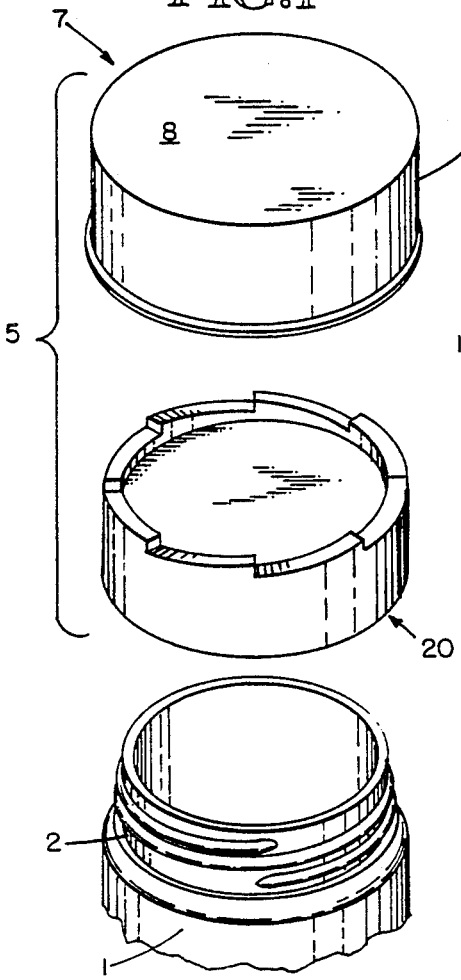
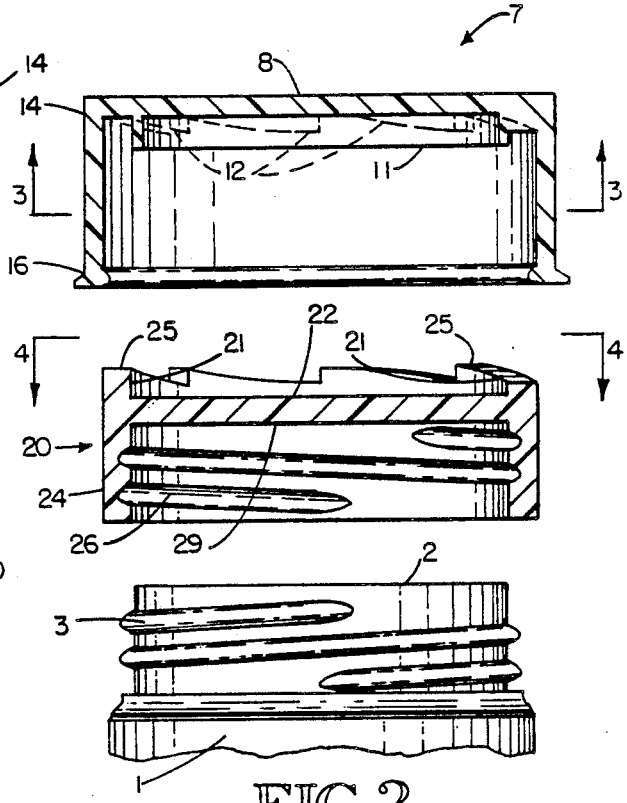
FIG. 2
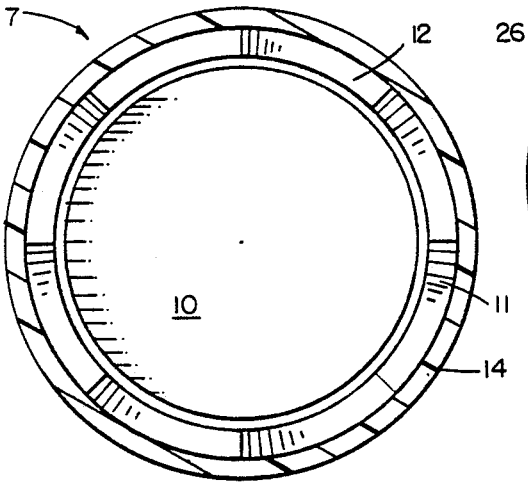
FIG. 3
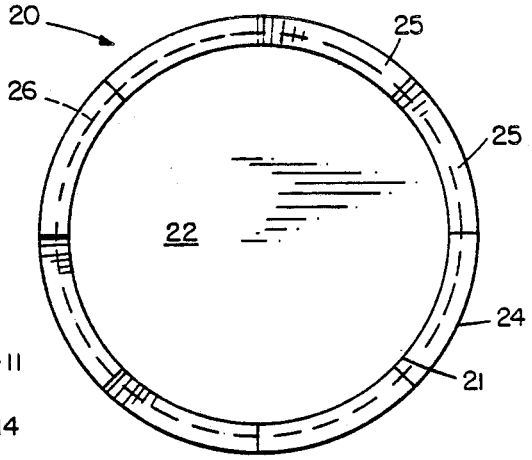
FIG. 4

WASTE DISPOSAL CONTAINER WITH A NON-REMOVABLE, PERMANENT CLOSURE

TECHNICAL FIELD

This invention relates to containers having closures. More particularly, this invention relates to containers for solid and liquid waste having threaded closures that, when initially attached, are non-removable and permanently sealing.

BACKGROUND INFORMATION

Today, improper disposal or storage of hazardous or toxic waste materials is a major cause of environmental contamination. For those industries which must safely handle and disposed of these materials, it is important that containers and their attached closure means be not only, strong, durable and physically and chemically compatible with the disposed waste material, but also, designed properly. In presently available disposal containers, the closure may be opened and removed even after completion of filling of the container when the materials being discarded.

In the health care industry, for example, it is necessary to properly disposed of a wide range of materials, such as dirty needles and syringes, discarded medication ampules and vials, used IV bags and tubing, dirty wound dressings, blood supply containers, etc. The disposal containers chosen to hold these materials must be strong and durable and available with different container neck-size openings. Their attached closures must allow for the daily disposal of these materials.

Currently available waste disposed containers do not have closures that are both non-removable and permanently sealing. Many of the waste disposal containers presently found in hospitals, clinics, and dentist offices have snap-on closures or conventional threaded closures. Such closures are easily removed and do not permanently seal the containers and, therefore, undesirable for the disposal of these types of waste products.

Various patents, discussed below, have been issued disclosing containers particularly for use in dispensing pharmaceuticals or hazardous chemicals such as bleach having tamper-resistant or "child proof" closures.

Uhlig, (U.S. Pat. No. 4,209,100), discloses two safety closure features. First, it discloses a safety closure for containers of harmful products having a locking flap hinged to an outer cap body which folds and seals one or more dispensing openings provided in the cap body. Cooperating latching surfaces are provided on the flap and the body portion to retain the flap in a folded, closed position. In order to open the container, the cap body must be squeezed simultaneously with lifting the flap; a task not easily performed by small children. A second safety feature uses a plurality of circumferentially spaced ratchet teeth located on the lower edge of the cap body which cooperate with vertical oriented spines located on the container neck.

Gach, (U.S. Pat. No. 4,747,498), discloses a container having a nonrefillable, safety dispensing cap closure. In one embodiment, the container neck terminates in circumferentially spaced ratchet teeth which coact with an circumferentially spaced ratchet teeth found in the closure cap.

Duponti, (U.S. Pat. No. 1,773,830), discloses a nonrefillable bottle having an outer threaded cap that covers an inner valve cap permanently attached to the bottle neck with spurs. The valve cap contains a valve mechanism that prevents the bottle from being refilled.

It is also known to use a waste disposal container having a slidable closure which can be locked and permanently closed. Such closures, however, do not permanently seal the container.

None of these patents disclose containers with closures which are non-removable and which permanently seals the container for use as a waste disposal container.

DISCLOSURE OF THE INVENTION

It is a general object of this invention, as disclosed herein, to provide a container which will allow for the easy and safe disposal of solid and liquid waste materials.

It is another general object of this invention to provide a container which will allow for the safe transport of solid and liquid waste materials.

More specifically, it is an object of this invention to provide a container having a conventional threaded neck which can be attached to either a standard threaded closure cap or to a specifically designed compatible closure which is non-removable and permanently sealing.

It is a further object of this invention to provide a versatile threaded closure which is removable when attached to a standard threaded container neck and non-removable and permanently sealing when attached to specifically designed, compatible threaded container neck.

It is a still further object of this invention to provide a waste disposal container having a closure, which is easy and convenient to use and economical to manufacture and purchase.

The invention disclosed herein, in combination, comprises a container and a closure having an anti-removal means therebetween to securely seal the container when filled so that waste materials cannot be removed from the container after the closure is attached to the container. As shown in several embodiments, the containers disclosed herein may have standard threaded necks which can be used with standard threaded closures or with the closures having anti-removal means. A gasket can be attached to each closure embodiment to seal the container.

In order to achieve the above stated objects, the invention disclosed herein, consists of a closure means and a container made of strong, durable polymeric materials such as polyvinyl chloride or polyethylene or any other suitable material. The container has an open neck with an engagement means to permanently secure a closure means thereon. Both the container and neck opening can be made in various sizes to admit various types and shapes of waste materials. The closure means has complimentary engagement means to engage with an engagement means located on the container neck which act together to close the container. An anti-removal means is interposed between the closure and the container to preclude removal of the closure from the container after the container is filled disposed materials. A gasket may be attached to the inside of the closure to seal the container. The closure may be further secured by using suitable adhesives between the closure and the container.

In the first embodiment, the closure consists of a rotatable outer cap which surrounds an inner threaded base cap in a coaxial configuration. The outer cap has a flat top and a substantially cylindrical outer skirt. The inside surface of the flat top has a hollow cylindrical alignment ring which extends downwardly from the inside surface of the flat top and an alignment slot located between the alignment ring and the inside surface of the outer skirt. Circumferentially spaced ratchet teeth arranged in an annular pattern are located inside the alignment slot which engage complimentary circumferentially spaced ratchet teeth arranged in an annular pattern on the raised outer edge of the base cap. An inner bead is located along the lower edge of the outer skirt which engages with a chamfer located on the base cap.

The base cap in the first embodiment comprises an inner top and cylindrical inner skirt having internal threads which interengages with external threads located on the container neck. The outer surface of the inner top is slightly elevated above the central portion of the inner top. Circumferentially spaced ratchet teeth are located along the elevated outer surface which interengage with circumferentially spaced ratchet teeth located inside the alignment slot on the outer cap. When the closure is threaded on the container neck and tightened, the outer cap ratchet teeth engage with the base cap ratchet teeth to tighten the base cap securely upon the container. When counter-rotated, the ratchet teeth disengage thereby preventing the closure from being unthreaded and removed. A chamfer is located on the lower edge of the inner skirt which engages with the inner bead located on the outer skirt to secure the outer cap to the inner cap.

A gasket made of rubber, paper or other suitable material may be attached to the inside surface of the inner top of the base cap. When the base cap is attached to the threaded container neck and tightened, the gasket presses against the extending edge of the neck to seal the container. The gasket may include microencapsulated releasable adhesive materials which permanently bonds the base cap to the container when the base cap is forcefully tightened upon the container.

The central portion of the inner top of the base cap may be modified to provide greater support and strength to the container neck by using an inside cylindrical support ring which extends downwardly from the inside surface of the inner top. The vertical sides of the support ring are positioned adjacent to the inside surface of the container neck. Depending on the amount of strength or support desired, the lower edge of the support ring may be either open or closed. An O-ring gasket made of rubber or other suitable material may be attached to the inside surface of the base cap between the outer skirt and the support ring to seal the container.

Alternatively, the waste disposal container may be comprised of an outer cap having an anti-removal means which engage directly with an anti-removal means located on the container. With this embodiment the outer cap has a flat top and a substantially cylindrical outer skirt having an anti-removal means. The anti-removal means may include circumferentially spaced ratchet teeth located on the lower edge of the outer skirt which engage with circumferentially spaced ratchet teeth located on the container's shoulder. The lower edge of the skirt, herein after called a skirt extension, extends downwardly past the shoulder and prevents the insertion of a tool.

An engagement means is provided between the outer cap and the container to attach the outer cap to the container neck. The engagement means may include internal threads located on the inside surface of the outer skirt which engage with compatible threads located on the container neck. A gasket made of rubber, paper, or other suitable material may be attached to the inside surface of the outer cap's flat top to seal the container and, as described above, may include suitable releasable adhesives. The inside surface of the outer cap may also be modified to extend into the container neck to provide greater support to the container neck.

When the closure is threaded on the container neck, the ratchet teeth located on the outer cap and the shoulder engage and prevent the removal of the closure from the container.

The container neck may be indented so that the outer or inner skirt is in-line with the lower adjacent container surface. This configuration prevents the insertion of a tool used to remove the closure from the container.

With each embodiment, an adhesive compatible with the container neck, outer and base caps, and the discarded material may be applied along the threads and to the inside contacting surfaces to secure and further seal the container. For containers made of materials difficult to glue, such as polyethylene, inserts of adhesive receptive materials may be installed in the container neck to provide a secure base to which the cap can be secured.

Depending on the waste material generated, the various container neck openings can be used. For each container embodiment, a conventional threaded closure can be used until the final disposal is desired. A closure described herein can then be attached to permanently close and seal the container. The waste materials held inside the container can then be safely transported and properly discarded.

Other advantages of this invention will become more fully apparent to those skilled in the art from the following detailed description, taken in conjunction with the annexed sheets of drawings on which are shown several embodiments and modifications of this invention.

BRIEF DESCRIPTION OF THE DRAWINGS

FIG. 1 is a partial exploded perspective view of one embodiment of this invention.

FIG. 2 is a partial exploded, side elevation view, partly in section, of the device shown in FIG. 1.

FIG. 3 is a bottom plan view partly in section taken along lines 3—3 of FIG. 2.

FIG. 4 is a plan view of the top of the inner cap shown in FIGS. 1 and 2.

BEST MODE FOR CARRYING OUT THE INVENTION

Figure 5:
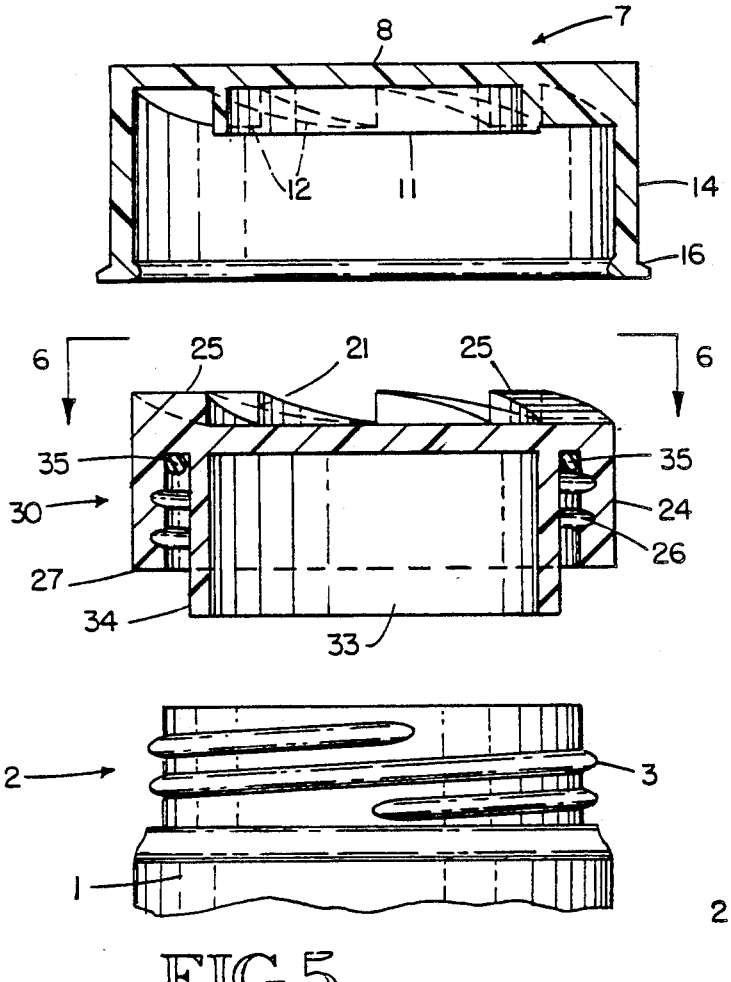
FIG. 5 is an exploded side elevation view, partly in section, of a another embodiment of the invention.

Referring particularly to the drawings, wherein like numerals indicate like parts, there is seen in FIGS. 1–4, the first and preferred embodiment of this invention. Container 1 has a container neck 2 with external threads 3 and a neck shoulder 4. Closure 5 consists of an outer cap 7 that fits over a base cap 20. Outer cap 7 consists of a flat top 8 and an substantially cylindrical outer skirt 14. Along the inside surface 13 of flat top 8 is a circular alignment ring 11 which extends downwardly defining alignment slot 9 with skirt inner wall 15. Eight circumferentially spaced ratchet teeth 12 arranged in an annular pattern are located inside alignment slot 9. Alignment ring 11 extends downwardly from the inside surface 13 just beyond the ratchet teeth 12 and engages the central portion 23 of base cap 20 as shown in FIGS. 2 and 3. Inner bead 17 located on the lower edge of outer skirt 14 interengages with chamfer 27 located on the base cap 20 to secure outer cap 7 to base cap 20.

Base cap 20 has a inner top 22 and a cylindrical inner skirt 24 having internally molded threads 26 which engage with complimentary external threads 3 located on neck 2. The outer surface 21 of inner top 22 is slightly elevated above the central portion 23. Eight complimentary circumferentially spaced ratchet teeth 25 arranged in a annular pattern are located on outer surface 21 which interengage with ratchet teeth 12. Chamfer 27 is located along the lower, outside edge of inner skirt 24.

The diameter of outer cap 7 is sightly greater than the diameter of base cap 20 and thereby fitting over base cap 20 when assembled. Chamfer 27 located on the outside, lower edge of base cap 20 interengages with inner bead 17. Ratchet teeth 25 and ratchet teeth 12 engage for uni-directional rotation when tightening the closure 7 onto neck 2 and disengage upon counter-rotation to prevent unthreading removal. As seen in FIG. 2, alignment ring 11 extends downwardly into the central portion 23 of base cap 20 positioned adjacent to elevated outer surface 21, reducing the lateral movement of outer cap and thereby, improving the engagement the caps 8 and 20.

Gasket 29 made of rubber, paper or other suitable material is attached to inside surface 28 of base cap 20 which presses against the extending edge of neck 2 when base cap 20 is tightened onto neck 2. Gasket 29 may include microencapsulated releasable adhesive materials (not shown) which permanently bonds base cap 20 to neck 2 when base cap 20 is forcefully tightened upon neck 2.

Prior to attaching closure 5 to container 1, an adhesive 6 (not shown) may be applied along threads 3 and threads 26 to further secure and seal container 1.

Figure 7:
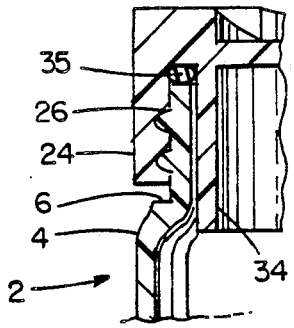
FIG. 7 is a partial side elevation view, in section taken along lines 7—7 of FIG. 5 showing a modification of the container neck.
Figure 6:
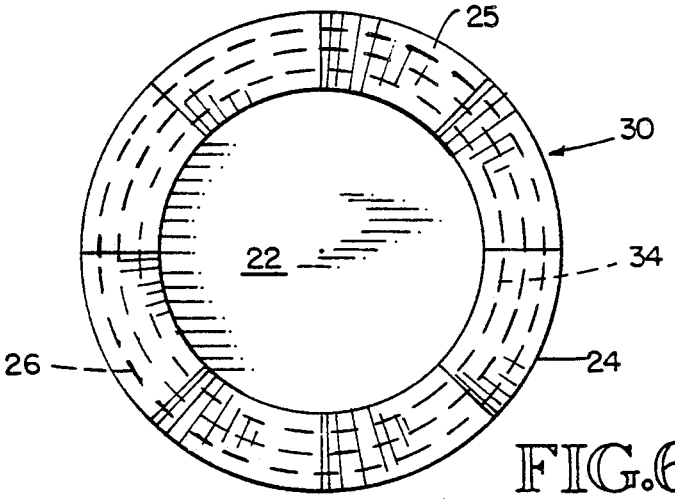
FIG. 6 is a plan view of the inner cap shown in FIG. 5.

FIGS. 5–7 show closure embodiment 19 including modified base cap 30 that can be used with outer cap 7 to provide additional support to neck 2. Base cap 30 includes an inner top 31 and an cylindrical inner skirt 34 having integral molded threads 36 which engage with threads 3 located on neck 2. Chamfer 61 is located along the lower, outside edge of inner skirt 34. Inner top 31 further includes a flat central portion 33 and an elevated outer surface 32 having eight circumferentially spaced ratchet teeth 35 arranged in an annular pattern which interengage with ratchet teeth 12. Depending from the inside surface 38 of central portion 33 is a cylindrical support ring 37. The outside surface 39 of support ring 37 is positioned adjacent to the inside surface of neck 2. Depending on the amount of additional strength or support needed, the bottom portion of support ring 37 may be open, as shown, or closed.

O-ring gasket 70 made of rubber or other appropriate elastomer is housed as shown between inside support ring 37 and outer skirt 34 to seal the container 1.

With each embodiment described above, neck 82 may be indented at shoulder 4, as shown in FIG. 7, so that the lower edges of outer skirt 14 and inner skirt 34 are in-line with lower outer surface of container 99. This configuration prevents the insertion of a tool used to pry and remove closure 5 from container 99.

Figure 8:
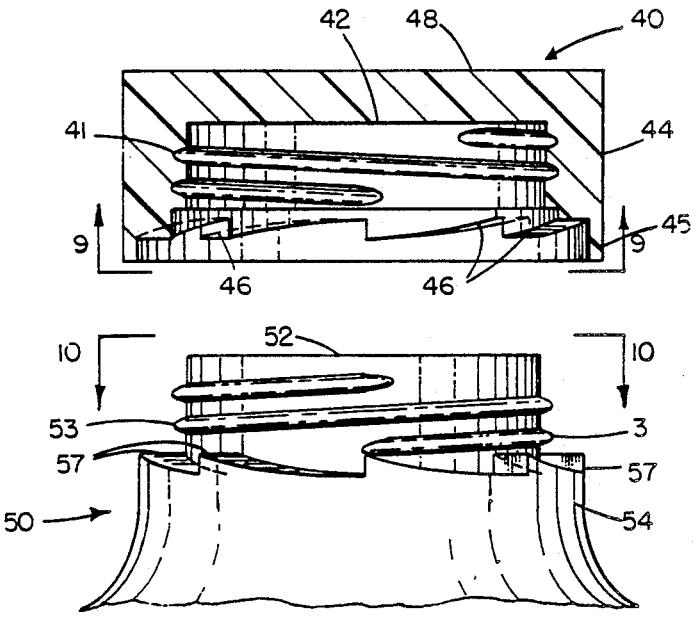
FIG. 8 is a side elevation view, partly in section of another embodiment of this invention.
Figure 9:
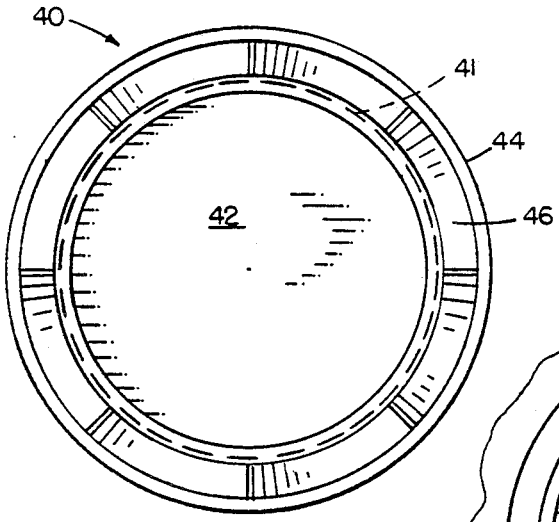
FIG. 9 is a bottom plan view of the outer cap shown in FIG. 8.
Figure 10:
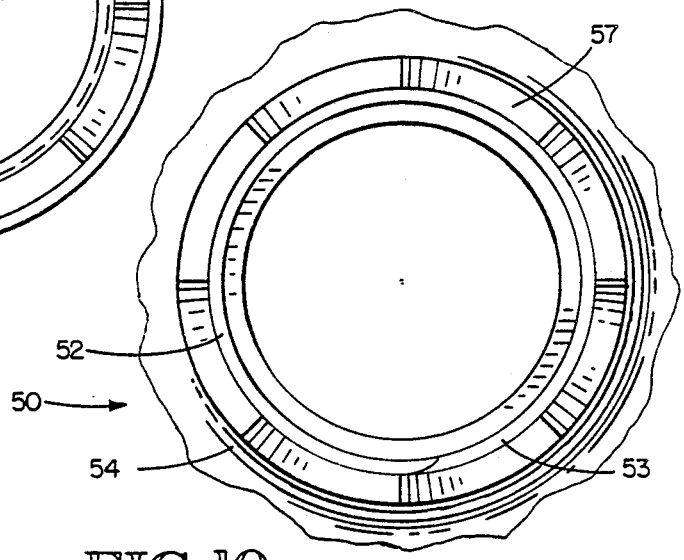
FIG. 10 is a plan view of the container shown in FIG. 8.

FIGS. 8–10 show still another embodiment of the invention. Outer cap 40 has a flat top 48 with a cylindrical outer skirt 44 having internal threads 41 which threadingly engage threads 53 located on the neck 52. Located on the lower edge of outer skirt 44 are a plurality of circumferentially spaced ratchet teeth 46 arranged in an annular pattern.

Container 50 includes open neck 52 having a shoulder 54. On shoulder 54 are eight complimentary circumferentially spaced ratchet teeth 57 which interengage with teeth 46 when outer cap 40 is threaded and tightened onto neck 52. The engagement of teeth 46 and 57 prevent unthreading removal of the outer cap from the neck 52. Along the lower edge of the skirt 44 is a skirt extension 45 which extends below shoulder 54 and prevents the insertion of a tool used to pry or separate outer cap 40 from container neck 52. A greater or lessor number of ratchet teeth may be used as desired.

Gasket 42 made of rubber or paper or other suitable material is attached to the inside surface 47 of flat top 48 to seal container 50.

With each embodiment of this invention described herein, an adhesive 6 compatible with the containers, outer caps and base caps may be applied to the contacting threads and cap surfaces.

Containers 1 and 50 can be manufactured in different sizes and with different neck size openings for the disposal of different waste products. A dentist, for instance, may choose a container suitable for disposing sharp objects. A nurse, on the other hand, may choose a container which will hold dirty wound dressings and gauzes. The type of waste materials will determine the container size and the neck opening selected.

When the containers 1 and 50 are being filled with waste materials, a standard threaded cap may be attached temporarily to the container neck until the container is full. Once the container 1 is full, either closure 5 or 19 can then be attached to container 1 and outer cap 40 can be attached to container 50.

In the first embodiment, as shown in FIGS. 1–4, threaded teeth 26 of base cap 20 interengage with threads 3 located on neck 2. Base cap 20 is turned clockwise to tighten onto neck 2. Gasket 29 located on inner surface 28 of base cap 20 is pressed against the upper edge of neck 2 when base cap 20 is tightened onto neck 2.

During the tightening process, outer cap 7 is pressed downwardly engaging ratchet teeth 12 located on outer cap 7 with ratchet teeth 25 located on base cap 20. Ratchet teeth 12 and ratchet teeth 25 are designed to engage when outer cap 7 is turned clockwise and to disengage when outer cap 7 is turned counterclockwise. Alignment ring 11 located on inner surface 13 of outer cap 7 aligns outer cap 7 with base cap 20. When closure 5 is tightened onto neck 2, gasket 29 presses against the upper edge of container neck 2 to seal container 1. Since ratchet teeth 12 and ratchet teeth 25 disengage when outer cap 7 is turned counterclockwise, removal of closure cap 5 is prevented. For materials that are highly toxic, a compatible adhesive may be applied to the contacting surfaces between the threads and closure cap to further secure the closure to the container. Microencapsulated adhesives may be placed inside gasket 29 which are released onto the contacting surface when base cap 20 is tightened onto neck 2.

When it is desirable to provide greater support and strength to neck 2, base cap 30 having a support ring 37 may be used. With this embodiment, closure cap 19, comprised of outer cap 7 and base cap 30, can be first manufactured, assembled and shipped to the user as a complete unit. Alternatively, base cap 30 could be manufactured and shipped separately for later assembly by the user. By shipping closure cap 19 separately, the user is able to select alternative base caps. O-ring gasket 70 located between inner skirt 34 and cylindrical ring 37 is pressed against the upper edge of neck 2 when closure 19 is tightened onto neck 2. When outer cap 7 is press downwardly and threaded onto neck 2 and tightened, ratchet teeth 35 and ratchet teeth 12 engage during clockwise rotation. Ratchet teeth 35 and 12 disengage when outer cap 7 is slightly lifted or during counterclockwise rotation and thereby prevent removal of closure cap 19 from the container.

The user could select the embodiment of this invention shown in FIGS. 8, 9, and 10. Container 50 has a threaded neck 52 and circumferential ratchet teeth 57 located on shoulder 54. Outer cap 40 has circumferential spaced ratchet teeth 46 located along the lower edge of outer skirt which interengage with ratchet teeth 57. When outer cap 44 is tightened by turning clockwise onto container neck 52, ratchet teeth 46 engage with ratchet teeth 57. During counterclockwise rotation of outer cap 40, ratchet teeth 46 and 57 disengage and thereby prevent removal of cap 44. Gasket 42 located on the inside surface 47 of outer cap 40 presses against the upper edge of neck 52 to seal container 50. An adhesive may be applied along the contacting threads and closure surfaces to attach closure 40 more securely.

In compliance with the statute, the invention has been described in language more or less specific as to its features. It is to be understood, however, that the invention is not limited to the specific features shown, since the means and composition disclosed comprise preferred forms of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

Containers having closures which, when initially attached, are non-removable and permanently seal the container will find wide spread use in industries handling a large variety of solid and liquid waste materials. Industries, such as the health care industry, which produce and accumulate waste material daily which require special handling, storage, and transport to prevent environmental contamination would find containers disclosed herein useful.

I claim:

1. A container for the disposal of solid and liquid waste materials, comprising, in combination:

(a) a container having an open neck, said neck having a cap engagement means to interengage a rotatable closure means thereon for closing and sealing said container;

(b) a closure having an outer cap and a base cap, said outer cap having a top and a substantially cylindrical outer skirt that extends downwardly from said top and surrounding said base cap, said top having an inside surface;

(c) said base cap comprising an inner top having an inside surface and a cylindrical inner skirt, said inner skirt having internal container engagement means for attaching said cap to said cap engagement means on said neck; and, (d) a anti-removal means interposed between said outer cap and said base cap, whereby when said closure is seated onto said neck, removal of said closure from said neck is prevented.

2. A container as recited in claim 1, wherein said closure further comprises a hollow cylindrical alignment ring attached to said inside surface of said top, said ring extending downwardly engaging said inner top of said base cap to maintain said top and said base cap in a coaxial configuration.

3. A container as recited in claim 1, further comprising a gasket attached to said inside surface of said base cap thereby sealing said container when said closure is attached to said container.

4. A container as recited in claim 3, wherein said gasket contains an adhesive, whereby said adhesive is released onto said base cap and said container neck when said closure is attached to said container.

5. A container as recited in claim 1, wherein said cap engaging means and said internal engaging means comprise compatible interior and exterior threads which threadably attach said closure to said container neck.

6. A container as recited in claim 5, further comprising an adhesive applied to said interior and exterior threads to permanently attach said closure to said container.

7. A container for the disposal of solid and liquid waste materials, comprising, in combination:

(a) a container having an open neck, said neck having a cap engagement means to interengage a rotatable closure means thereon for closing and sealing said container;

(b) a closure having an outer cap and a base cap, said outer cap having a top and a substantially cylindrical outer skirt that extends downwardly from said top and surrounding said base cap, said top having an inside surface;

(c) said base cap comprising an inner top having an inside surface and a cylindrical inner skirt, said inner skirt having internal container engagement means for attached said cap to said cap engagement means on said neck; and (d) a anti-removal means interposed between said outer cap and said base cap, whereby when said closure is seated onto said neck, removal of said closure from said neck is prevented;

(e) wherein said closure further comprises a depending cylindrical support ring attached to said inside surface of said inner top, said depending cylindrical support ring having vertical sides which extend downwardly into and are positioned adjacent to said inner surface of said container neck, whereby greater support and strength is provided to said container neck.

8. A container for the disposal of solid and liquid waste materials, comprising, in combination:

a container having an open neck, said neck having a cap engagement means to interengage a rotatable closure means thereon for closing and sealing said container;

a closure having an outer cap and a base cap, said outer cap having a top and a substantially cylindrical outer skirt that extends downwardly from said top and surrounding said base cap, said top having an inside surface;

said base cap comprising an inner top having an inside surface and a cylindrical inner skirt, said inner skirt having internal container engagement means for attaching said cap to said cap engagement means on said neck; and, an anti-removal interposed between said outer cap and said base cap, said anti-removal means further comprising:

(a) a plurality of circumferentially spaced ratchet teeth arranged in an annular pattern on said inside surface on said outer cap; and, (b) a plurality of circumferentially spaced ratchet teeth arranged in an annular pattern on said inner top on said base cap, whereby said ratchet teeth located on said outer cap and said ratchet teeth located on said base cap interengage and prevent unthreading removal of said base cap from said container.

9. A waste disposal container comprising:

(a) a container having an open neck with external threads;

(b) a closure comprising an outer cap and a base cap, said outer cap having a top with an inside surface and a substantially cylindrical outer skirt, said outer cap having a downward extending alignment ring and an alignment slot located on said inside surface, said outer cap having circumferentially located ratchet teeth located inside said alignment slot;

(c) a base cap surrounded by said outer cap, comprising an inner top and inner skirt, said inner top having a central portion and an elevated outer edge, said central portion having an inside surface, said outer edge having circumferentially located ratchet teeth which engage with said ratchet teeth located on said outer cap; and, (d) a gasket attached to said inside surface of said base cap whereby sealing said open neck when said base cap is attached when said closure is attached to said external threads.

10. A waste disposal container comprising, in combination:

(a) a container having an open neck and a shoulder below, said neck having a inside periphery and a cap engagement means to engage a rotatable closure means thereon for closing and sealing said container;

(b) a closure having a closure top and a substantially cylindrical outer skirt extending downward along the periphery of said neck to a lower edge of said neck, said outer skirt having a container engagement means for attaching said closure to said container; and, (c) an anti-removal means interposed between said closure top and said container preventing removal of said closure from said neck when said closure is attached to said neck.

11. A container as recited in claim 10, further comprising an extension lip attached to said outer skirt, said extension lip extending downwardly covering said shoulder, whereby preventing the insertion of a tool edge between said container and said closure.

12. A container as recited in claim 10, further comprising a gasket attached to the inside surface of said outer cap thereby sealing said container when said outer cap is attached to said container.

13. A container as recited in claim 12, wherein said gasket contains an adhesive, said adhesive releasable onto the contacting surfaces of said container neck and said outer cap.

14. A container as recited in claim 10, wherein said cap engagement means and said container engagement means comprises compatible interior and exterior threads which threadedly attaches said outer cap to said container neck.

15. A container as recited in claim 10, wherein said antiremoval means comprises:

(a) a plurality of circumferentially spaced ratchet teeth arranged in an annular pattern on said inside surface on said outer cap; and, (b) a plurality of circumferentially spaced ratchet teeth arranged in an annular pattern on said neck, whereby said ratchet teeth located on said outer cap and said ratchet teeth located on said container interengage and prevent unthreading removal of said outer cap from said container.

16. A container as recited in claim 10, wherein said anti-removal means comprises:

(a) a plurality of circumferentially spaced ratchet teeth arranged in an annular pattern attached to said container; and (b) a plurality of circumferentially spaced ratchet teeth in an annular pattern attached to said closure means whereby said closure means is non-removable when said closure means is attached to said container.

* * * * *